United States Patent [19]

Kogiso et al.

[11] Patent Number: 4,769,982

[45] Date of Patent: Sep. 13, 1988

[54] APPARATUS FOR PREVENTING UNWINDING OF ROVING END APPLIED TO ROVING BOBBIN TRANSPORTING SYSTEM

[75] Inventors: Takashi Kogiso, Mizunami; Yoshio Kurachi, Aichi, both of Japan

[73] Assignee: Howa Machinery, Ltd., Aichi, Japan

[21] Appl. No.: 54,938

[22] Filed: May 27, 1987

[30] Foreign Application Priority Data

May 28, 1986 [JP] Japan ..... 61-122548
Jun. 21, 1986 [JP] Japan ..... 61-145451

[51] Int. Cl.[4] ..... D01H 9/18; D01H 9/00

[52] U.S. Cl. ..... 57/281; 57/267; 57/278

[58] Field of Search ..... 57/266, 267, 273, 274, 57/276–278, 281, 90

[56] References Cited

U.S. PATENT DOCUMENTS

| | | | |
|---|---|---|---|
| 3,681,905 | 8/1972 | Furtmeier et al. | 57/267 X |
| 3,935,699 | 2/1976 | Iida et al. | 57/267 |
| 4,023,338 | 5/1977 | Tooka et al. | 57/281 X |
| 4,196,575 | 4/1980 | Novak | 57/267 |
| 4,369,621 | 1/1983 | Kogiso | 57/274 X |
| 4,438,622 | 3/1984 | Pons | 57/281 X |
| 4,473,997 | 10/1984 | Kawasaki et al. | 57/276 |
| 4,548,029 | 10/1985 | Araki et al. | 57/281 X |
| 4,583,358 | 4/1986 | Krieger et al. | 57/281 |
| 4,586,326 | 5/1986 | Igel | 57/281 |
| 4,630,435 | 12/1986 | Igel | 57/281 |

FOREIGN PATENT DOCUMENTS

| | | |
|---|---|---|
| 3146040 | 6/1983 | Fed. Rep. of Germany . |
| 57-106729 | 7/1982 | Japan . |
| 61-3896 | 2/1986 | Japan . |
| 61-174432 | 8/1986 | Japan . |
| 2089379 | 6/1982 | United Kingdom . |

*Primary Examiner*—John Petrakes
*Attorney, Agent, or Firm*—Michael N. Meller

[57] ABSTRACT

An apparatus for preventing an unwinding of a roving end from a full package roving bobbin during the transportation thereof. This apparatus is constructed in combination with the transportation mechanism formed in the known doffing mechanism or known overhead roving bobbin transportation system, in a condition such that a part of the constitutional mechanical elements of such known transportation mechanisms are utilized as a part of the constitutional mechanical elements of the apparatus according to the present invention. In the apparatus of the present invention, a pressing member is utilized for applying pressure against the peripheral face of the winding portion of each roving bobbin while this bobbin is rotating, and therefore the free end of the roving is firmly attached to the above-mentioned peripheral face of the roving bobbin. Consequently, any possible problems due to an unexpected unwinding of the roving can be effectively prevented.

8 Claims, 10 Drawing Sheets

APPARATUS FOR PREVENTING UNWINDING OF ROVING END APPLIED TO ROVING BOBBIN TRANSPORTING SYSTEM

BACKGROUND OF THE INVENTION

1. Technical Field

The present invention relates to an apparatus for preventing an unwinding of an end of a roving when roving bobbins doffed from a roving frame are transported to the vicinity of a creel of a spinning frame or the roving bobbins are mounted to the respective creels of the spinning frame.

2. Description of the Related Art

As a means for transporting roving bobbins doffed from roving frames to spinning frames, a roving bobbin transporting system has been developed in which a transporting rail system is arranged between the positions above the roving frames and the positions above the spinning frames, bobbin carriages are movably supported by the transporting rail system, roving bobbins doffed from the flyer frames are suspended from respective bobbin hangers of the bobbin carriages so that the roving bobbins are transported in this suspended condition to the respective positions above the spinning frames. Furthermore, as means for mounting roving bobbins transported to the respective positions above the spinning frames to the respective spinning creels, a roving bobbin exchange apparatus has been developed so that roving bobbins are automatically exchanged with empty bobbins on the respective spinning creels.

When roving bobbins are transported by the above-mentioned roving transporting system or roving bobbins are mounted on the respective spinning creels by the bobbin exchange apparatus, the following problem has arisen. Namely, since the roving end of a roving bobbin doffed from the roving frame is not sufficiently attached to the winding portion of the roving bobbin, the roving end separates from the winding portion of the roving bobbin and sags down during the transportation of the roving bobbins, or during the roving bobbin exchange operation in the spinning frame. This sagging occurs frequently in the case of a combed yarn, and the weight of the roving in the sagging portion causes the roving on the roving bobbin to be gradually unwound, and the unwound roving of the roving bobbin is scattered and causes various problems.

SUMMARY OF THE INVENTION

It is an object of the present invention to provide an apparatus for preventing an unwinding of a roving end in a roving bobbin, which can solve the above-mentioned problem. This apparatus has a function of firmly attaching a free end of a roving to the outer periphery of the winding portion of each roving bobbin, while the roving bobbins, doffed from the respective bobbin wheels of each roving frame, are displaced by a transporting means. More specifically, the present invention relates to an apparatus having a function such that, while full roving bobbins doffed from the respective bobbin wheels of each roving frame are carried by the transporting means, each bobbin is rotated in the winding direction of the roving in a condition such that the peripheral face of the winding portion of each roving bobbin is under pressure by a certain pressing member, whereby the free end of the roving is firmly attached to the periphery of the winding portion of the roving bobbin.

A transporting system, in which the apparatus for preventing an unwinding of the roving end according to the present invention is built, includes various embodiments according to the system for transporting doffed roving bobbins to the spinning frames. This transporting system includes an embodiment in which a transporting apparatus having many bobbin hangers is moved along a transporting rail arranged between respective positions above the roving frames and respective positions above the spinning frames, while suspending doffed roving bobbins by respective bobbin hangers so that the doffed roving bobbins are transported from respective positions above roving frames to the respective positions above the spinning frames, and an embodiment in which full bobbins doffed from each roving frame are delivered to corresponding bobbin hangers of the above-mentioned transporting apparatus. The latter embodiment includes different modes adopted for the simultaneous doffing method and the method using a wagon type doffer, respectively.

In each case, the transporting system, including the apparatus of the present invention, comprises a moving body having supporting members for holding each roving bobbin in a condition such that each roving bobbin is substantially vertically supported, and means for displacing the moving body along a predetermined track, and in this transporting system, the roving bobbins taken out from the respective bobbin wheels of the roving frame are supported by the supporting member while being displaced to predetermined positions. The apparatus of the present invention comprises, in principle, a pressing member disposed in the vicinity of the predetermined track of this transporting system to apply pressure to the peripheral face of the winding portion of each roving bobbin and a mechanism for rotating the roving bobbin in the winding direction of a roving under the pressing action of the pressing member.

As is apparent from the above-mentioned basic construction of the apparatus of the present invention, irrespective of the embodiments, the apparatus for preventing the unwinding of an end of a roving of each roving bobbin according to the present invention is characterized in that pressure is applied to the peripheral face of a roving bobbin by the pressing member while transporting the bobbin, and the roving bobbin is rotated in the winding direction of the roving by the bobbin-rotating mechanism under the above mentioned pressure, whereby the roving end of the roving bobbin is pressed against the winding portion of the roving bobbin and firmly attached thereto, and thus the above-mentioned problems are satisfactorily solved.

DESCRIPTION OF THE PREFERRED EMBODIMENTS

The construction and function of an embodiment in which the roving end unwinding-preventing apparatus of the present invention is applied to an apparatus for mounting roving bobbins doffed from a roving frame to corresponding bobbin hangers of a bobbin carriage of a roving bobbin transporting apparatus of the overhead bobbin transporting system will now be described with reference to FIGS. 1 through 4.

Figure 1:
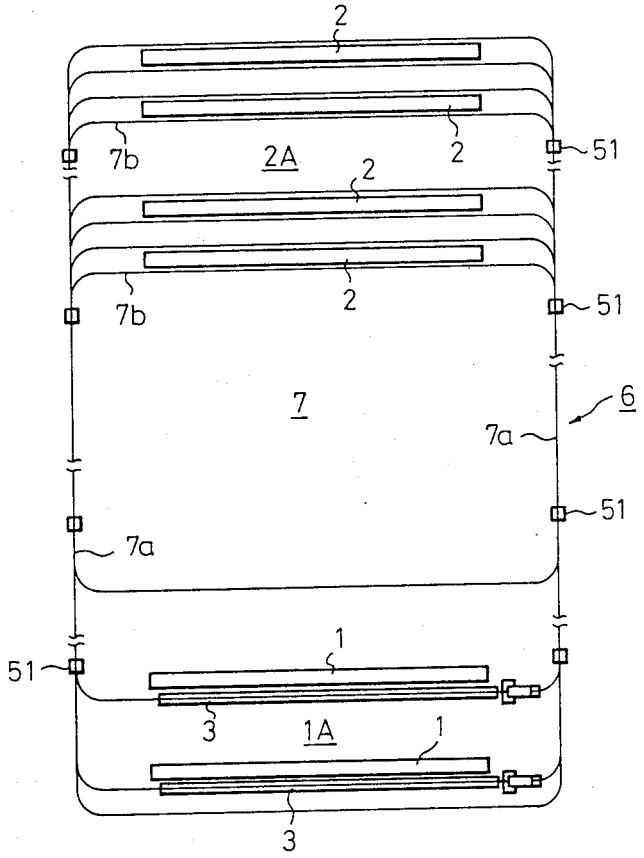
FIG. 1 is a plane view illustrating the layout of a roving bobbin transporting system (simultaneous doffing system) arranged between the respective positions above roving frames and the respective positions of spinning frames.
Figure 2:
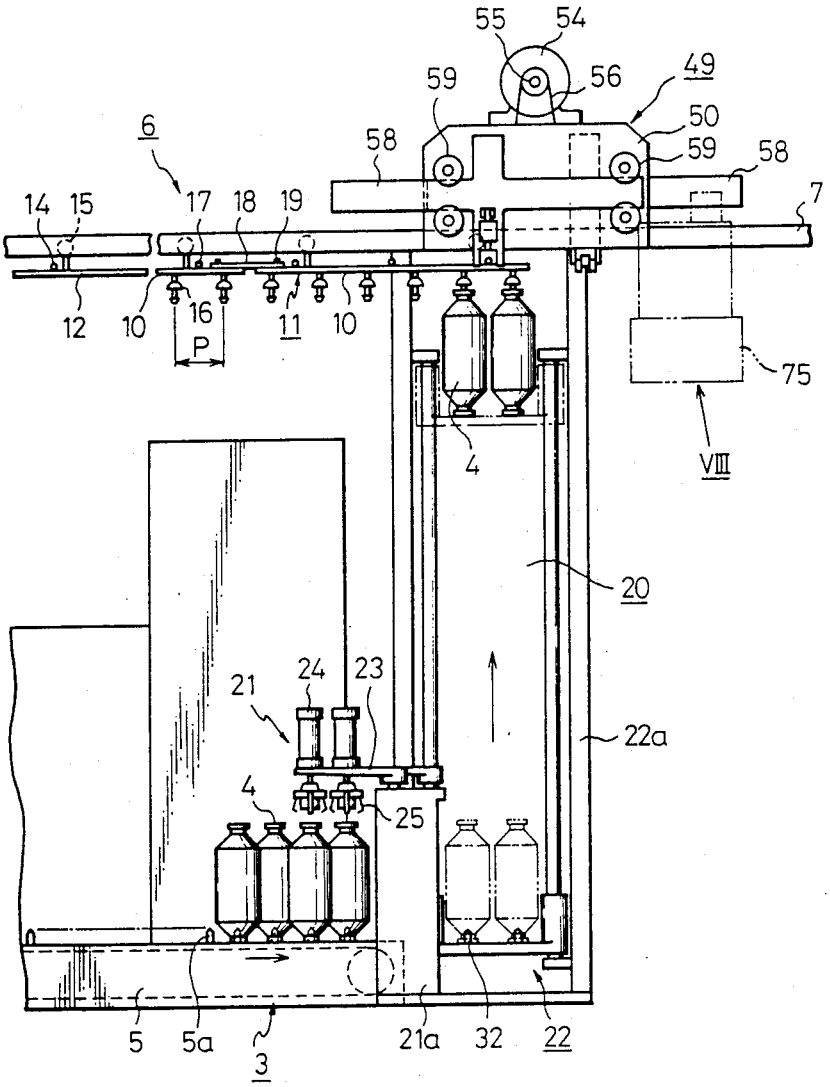
FIG. 2 is a partial front view of the roving bobbin transporting system shown in FIG. 1, in relation to a full bobbin mounting apparatus wherein the apparatus of the present invention is applied, which is disposed at a position adjacent to one end of a peg conveyor constituting a part of the simultaneous doffing apparatus.

In FIG. 1, a plurality of roving frames 1 and a plurality of spinning frames are arranged according to the production capacity of the mill. A simultaneous doffing apparatus 3 is disposed in front of each roving frame 1. This simultaneous doffing apparatus 3 is constructed so that all the roving bobbins 4 of each roving frame 1 are simultaneously doffed from the respective bobbin wheels of the roving frame and then mounted on a peg 5*a* of the peg conveyor 5 as shown in FIG. 2. The structure of this simultaneous doffing apparatus 3 is illustrated, for example, in Japanese Unexamined Patent Publication No. 57-106729, U.S. Pat. No. 4,369,621, GBP No. 2,089,379 or WGP No. 3,146,040. In the present invention, the specific structure of the simultaneous doffing apparatus is not particularly critical and, accordingly, an explanation thereof is omitted.

An overhead roving bobbin transporting system 6 transports roving bobbins 4 doffed by the simultaneous doffing apparatus 3 to a corresponding spinning frame 2, and this transporting system 6 has the following construction. That is, a transporting rail 7 is arranged in a space between the roving frame-setting position 1A and the spinning frame-setting position 2A. The transporting rail 7 comprises branch rails 7*b* arranged along the respective roving frames 1 and spinning frames 2 and a main rail 7*a* connecting these branch rails 7*b*. The rails 7*a* and 7*b* are supported by brackets secured to the machine stands or ceiling. Each bobbin carriage 11 comprising a plurality of carrying members 10 is suspended on the transporting rail 7 so that each bobbin carriage 11 can move along the transporting rail 7. As shown in FIG. 2, in each carrying member 10, supporting levers 14 are secured to a carriage bar 12, and wheels (not shown) rotatably supported on both sides of a bearing portion (not shown) of the supporting lever 14 are placed on the supporting face of the transporting rail 7. On the lower face of the carriage bar 12, bobbin hangers 16 are mounted at predetermined pitches P in the longitudinal direction of the carriage bar 12, and indexing pins 17 are secured to the upper face of the carriage bar 12 at pitches two times the attachment pitches P of the bobbin hangers 16, so that the indexing pins 17 expand from both edges of the carriage bar 12.

A plurality of such carrying members 10 are connected by connecting bars 18 and connecting pins 19 so that the line of the carrying members 10 can be bent and the pitches between every two adjacent carrying members 10 are equal to the pitches P. In general, the pitches P of the bobbin hangers 16 are adjusted to 2 times the spindle pitches in the spinning frame 2.

A displacing device 20 for mounting the roving bobbins 4 doffed by the simultaneous doffing apparatus 3 to the respective bobbin hangers 16 of the bobbin carriage 11, comprises a bobbin transfer device 21 which is disposed in the vicinity of one end of the peg conveyor 5 so as to receive doffed roving bobbins 4 on the respective pegs 32 of a device 22 for lifting these received roving bobbins 4 to the respective bobbin hangers 16. The bobbin transfer device 21 comprises a pair of arms 23 mounted on a frame 21*a* of the device 21 in rotatable condition of predetermined angle and a plurality of holding claws 25 which are vertically movably supported on the top ends of the arms 23 which is actuated by a pneumatic cylinder 24 mounted on the device 21. These holding claws 25 can be opened and closed by a cylinder (not shown in the drawings). The top ends of the roving bobbins 4 supported by the pegs 5*a* of the peg conveyor 5 are held by these holding claws 25 and, thereafter, the roving bobbins 4 are taken from the pegs 5*a*, and the roving bobbins 4 are mounted on respective pegs 32, described below, of the lifting device 22.

Figure 3:
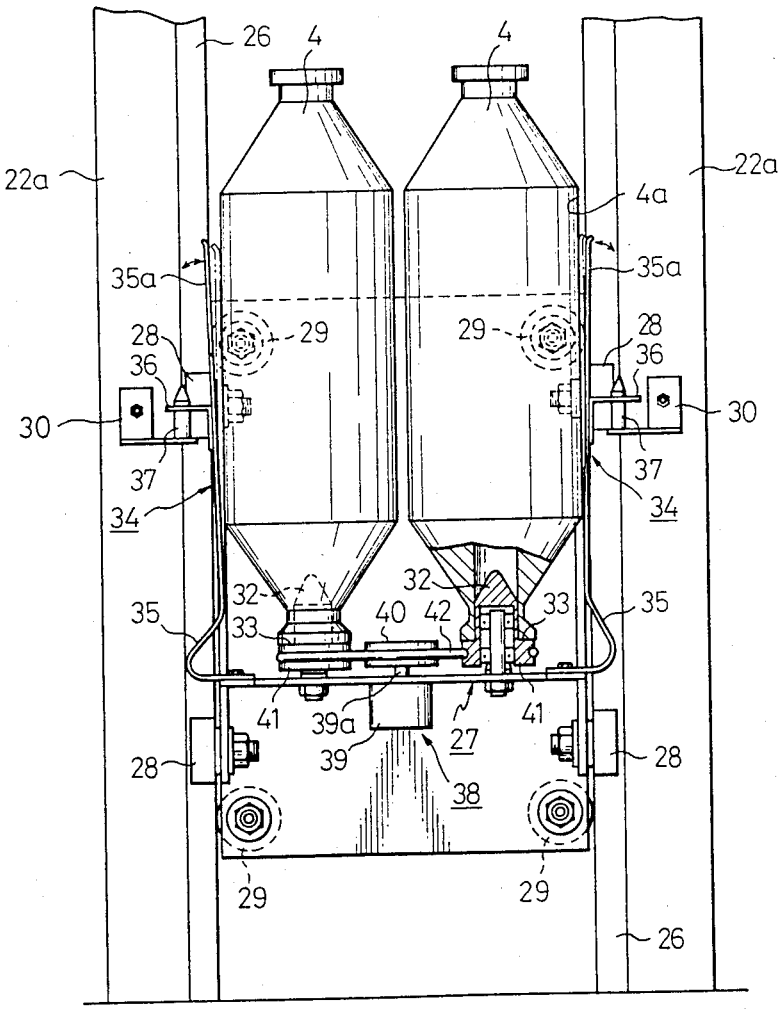
FIG. 3 is a front view of the roving end unwinding-preventing apparatus of the present invention which is combined with a part of mechanical elements constituting a roving bobbin lifting mechanism which is a part of the full bobbin-mounting apparatus shown in FIG. 2.
Figure 4:
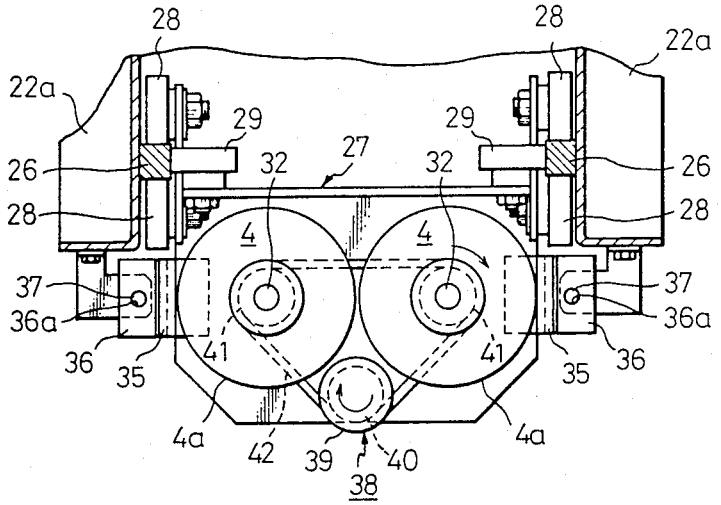
FIG. 4 is a plane view showing a main part of the roving end unwinding-preventing apparatus shown in FIG. 3.

The roving end unwinding-preventing apparatus of the present invention is built in a part of mechanical elements constituting the lifting device 22, as shown in FIGS. 3 and 4.

In the lifting device 22, a pair of vertical guide rails 26 are secured to left and right frames 22*a*. A lifter 27 is guided by the guiding rails 26, and the lifter 27 has a function of displacing roving bobbins upwards or downwards between two positions, that is a position for receiving doffed roving bobbins 4 by the respective pegs 32 and another position for transferring the above-mentioned roving bobbins 4 to the respective bobbin hangers 16 of the bobbin carriage 16. In this embodiment, the pegs 32 function as members for supporting the respective roving bobbins, while the lifter 27 functions as a displacing body for displacing the respective supporting members, that is the pegs 32. A pair of guiding rollers 28 and a pair of regulating rollers 29 are rotatably attached to upper and lower parts of both the end portions of the lifter 27 through brackets. The guide rails 26 are held between the guiding rollers 28 and the regulating rollers 29 abut against the guiding rails 26 to maintain the posture of the lifter 27. This lifter 27 can be moved up and down by a predetermined distance by an appropriate lift mechanism operated by a pneumatic cylinder or motor, for example, a mechanism disclosed in Japanese Unexamined Patent Publication No. 58-41919. A pair of pegs 32 are rotatably mounted on the lifter 27 through bearings or the like in condition such that they project upwards, and when the lifter 27 is displaced to the uppermost position, the pegs 32 can be positioned to vertically confront two bobbin hangers 16 of the bobbin carriage 11 guided by the transporting rail 7. Each peg 32 is formed so that it can be inserted into the lower aperture of each roving bobbin 4 and each peg 32 has a receiving part 33 for receiving the lower face of the mounted roving bobbin 4. In this embodiment, the pressing device and a part of the mechanism for revolving the pegs 32 are symmetrically disposed to the respective pegs 32 of the lifter 27, respectively. The construction and function of these machine elements related to one of these pegs 32 are hereinafter explained. A pressing device 34 is mounted on the lifter 27 in a condition such that it is capable of pressing against the peripheral face of the roving bobbin 4 supported by the respective pegs 32. This pressing device 34 is provided with a plate spring 35 having a free end, and the base portion (lower portion) of the plate spring 35 is secured to the lifter 27 and a pressing portion 35*a* is formed on the top end of the plate spring 35 so that, in the natural state, the pressing portion 35*a* is capable of pressing against the peripheral face of the roving bobbin 4 mounted on the peg 32. As shown in FIG. 4, an engaging piece 36 having a engaging aperture 36*a* extending in the vertical direction is integrally secured to the top end of the plate spring 35. A releasing pin 37 is secured to a frame 22*a* of the lifting device 22 as the engaging member, and the engaging pin 37 is formed in a tapered shape so that by the engagement of the releasing pin 37 with the engaging aperture 36*a*, the pressing portion 35*a* of the plate spring 35 is deformed to a withdrawn position separated from the peripheral face of the roving bobbin 4.

Note, the other engaging pin (not shown) is disposed at the upper position of the frame 22*a* of the lifting device and facing the releasing pin 37. This mechanism has a function such that, before the roving bobbins 4 are transferred to the respective bobbin hangers 16, the contact pressure of the plate spring 35 against the peripheral surface of the winding portion 4*a* of each roving bobbin 4 is eliminated. The releasing member 37 may be a wedge piece or cam plate secured to the frame 22*a*, and in this case, an engaging piece is arranged on the plate spring 35 so that, when the lifter 27 is brought down, the engaging piece becomes engaged with the wedge piece or cam plate to displace the top end of the plate spring 35 outward. A bobbin-rotating mechanism 38 for revolving each peg 32 is secured to the frame of the lifter 27 for rotating the roving bobbin 4 mounted on the peg 32 in the winding direction of roving. This bobbin-rotatng mechanism 38, is provided with a driving motor 39 secured to the lifter 27, and a pulley 40 is secured to a driving shaft 39*a* of the driving motor 39. A pulley 41, which works as an element of the bobbin-rotating device 38, is formed integrally with the peg 32, and a belt 42 is led between this pulley 41 and the pulley 40. A dog (not shown) is integrally formed on the lifter 27 to actuate an upper limit switch (not shown) and a lower limit switch (not shown) at the falling and rising positions of the lifter 27, respectively. The driving motor 39 is arranged so that, when the lifter 27 rises and the dog separates from the lower limit switch, the driving motor 39 is rotated and driven, and when the dog actuates the upper limit switch, the driving motor 39 is stopped.

A feeding device 49 intermittently displaces the bobbin carriage 11 for a predetermined distance along the transporting rail 7. Since the detailed mechanism and function of this device 49 are disclosed in the Japanese Examined Utility Model Application No. Showa 61-3896, the construction and function of this device are hereinafter only briefly explained. In FIG. 2, a main body 50 of this device is secured to the transporting rail 7, and a driving shaft (now shown) is rotatably mounted on the main body 50. A brake motor 54 is mounted on the main body 50, and this brake motor 54 is provided with a speed reduction mechanism. A chain 56 is laid on a chain wheel secured to an output shaft 55 of the brake motor 54 and a chain wheel (not shown) secured to the above-mentioned driving shaft, so that this driving shaft can be rotated in a predetermined direction. A pair of cranks (not shown), which are respectively secured to both end portions of the above-mentioned driving shaft in a particular condition such that the angular phase difference with regard to the axial center of the driving shaft between these two cranks is 180°. These cranks are arranged in an almost horizontal condition respectively, and free end portions of these two cranks are connected to one of the cross-riders 58, respectively, which are supported on both sides of the main body 50 in a horizontal condition, respectively. In the above-mentioned mechanism, when the cranks have made a half turn, these two cross-riders 58 are displaced in opposite directions by a stroke which is twice the arrangement pitch P of the bobbin hangers 16, respectively. A mechanism for alternate engagement with and disengagement from the indexing pin 17 of the bobbin carriage 11 is mounted on these cross-riders 58 respectively, so that, when either one of these cross-riders 58 is displaced to a position wherein the free end portion thereof is in a backward end position (in FIG. 2). This mechanism engages with the indexing pin 17, while when either one of these cross-riders 58 is displaced to a position where free end portion thereof is in a forward end position (in FIG. 2), this mechanism disengages from the indexing pin 17. Therefore, according to the rotation of the brake motor 54, when the driving shaft is rotated by a half turn either one of the cross-riders 58 which is in the backward end position (in FIG. 2), comes to the most backward side, this cross-rider 58 engages with the indexing pin 17, and therefore, the bobbin carriage 11 can be displaced forward by a stroke which is twice that of the arrangement pitch P of the bobbin hangers 16, according to successive half turn rotations of the driving shaft.

In the above-mentioned embodiment, when roving bobbins 4 formed by the roving frame 1 are carried to the respective positions above spinning frames 2, the doffing machine 3 simultaneously doffs the roving bobbins 4 on the pegs 5*a* of the peg conveyor 5 from the roving frame 1. Then, the roving bobbins 4 on the peg conveyor 5 are displaced toward the bobbin-displacing device 20, and at the position where the first two roving bobbins 4 confront the holding claws 25 of the bobbin transfer device 21, the movement of the peg conveyor 5 is stopped. Then, the holding claws 25 hold the top ends of the roving bobbins 4 and take the roving bobbins 4 from the pegs 5, and the claws 25 mount the roving bobbins 4 on the pegs 32 of the lifter 27 in the falling condition in the lifting device 22. In this condition, the following action of the pressing device 34 is created for each peg 32, that is, the engaging aperture 36*a* of the engaging piece 36 in the pressing device 34 is engaged with the engaging pin 37 and the pressing portion 35*a* of the plate spring 35 is located outside the roving bobbin-present region on the lifter 27. Accordingly, the roving bobbins 4 can be easily mounted on the pegs 32 without coming in to contact with the pressing portions 35*a* (see FIG. 3). The driving motor 39 of the bobbin-rotating mechanism 38 is stopped in this condition and, therefore, the pegs 32 and the roving bobbins 4 mounted thereon are not rotated. On the other hand, the bobbin hangers 16 supported on the transporting rail 7 are moved to the positions confronting the pegs 32 on the lifter 27 and stopped at these positions. Then, the lifter 27 rises and the top ends of the roving bobbins 4 are transfered to the respective bobbin hangers 16 of the bobbin carriage 11. In the above-mentioned case, when the lifter 27 rises slightly from the lowermost position, regarding each peg 32, the engaging aperture 36*a* of the engaging piece 36 separates from the engaging pin 37, and as a result, the pressing portion 35a of the plate spring 35 is deformed inward (to the position indicated by a dot-line in FIG. 3) by the resilient force of the plate spring 35 per se, and the pressing portion 35*a* comes in to pressing contact with the peripheral faces of winding 4*a* of each roving bobbin 4 mounted on the respective pegs 32 (at the position indicated by the solid line in FIG. 4). Furthermore, when the lifter 27 rises slightly from the lowermost position, the dog separates from the lower limit switch, and by the output of this limit switch, the driving motor 39 of the bobbin-rotating mechanism 38 is rotated and driven to rotate the belt 42 in the direction indicated by the arrow (FIG. 4) and rotate the pegs 32 and each roving bobbin 4 mounted thereon in the roving-winding direction. In this case, since the pressing portion 35*a* of the plate spring 35 is in pressure contact with the peripheral face of the winding 4*a* of the roving bobbin 4 as mentioned above, the end of the roving is pressed against the winding 4*a* and firmly attached thereto by the rotation of each roving bobbin 4. When the lifter 27 rises to the upper position and actuates the upper limit switch, the rotation and driving of the driving motor 39 are stopped by the output of this limit switch. Every time the roving bobbins are taken out by the transfer device 21, the peg conveyor 5 feeds the subsequent two roving bobbins 4 to the take-out positions, and the lifter 27 of the lifting device 22 transfers the two roving bobbins 4 to a pair of bobbin hangers 16, respectively, and falls down again. When the transfer device 21 transfers the subsequent two roving bobbins 4 onto the lifter 27 from the peg conveyor 5, the lifter 27 rises again. When the lifter 27 falls down after the roving bobbins 4 are transfered to a pair of the bobbin hangers 16, this falling is detected by appropriate detecting means so that the brake motor 54 of the intermittent feeding device 49 is driven, whereby the driving shaft for actuating the cross-riders 58 is rotated by a half turn and the bobbin carriage 11 is displaced forward by a stroke which is twice that of the arrangement pitch P of the bobbin hangers 16.

If the bobbin carriage 11 is moved by a distance which is twice that of the pitches P in the above-mentioned manner, the two roving bobbins 4 transfered to a pair of the bobbin hangers 16 are displaced forwards in the suspended condition. This intermittent movement is effected every time the roving bobbins 4 are transfered to the bobbin hangers 16, and when a predetermined number of roving bobbins 4 are mounted on all the bobbin hangers 16 of the bobbin carriage 11, the bobbin carriage 11 is carried to the respective positions above the spinning frames 2 by a continuous feed device 51 (see FIG. 1), as hereinafter explained. In this case, although the roving bobbins 4 suspended by the bobbin hangers 16 are swung by air streams or the like in the mill and the roving ends are to be unwound, since the roving ends of the roving bobbins 4 are caught against the windings 4*a* in the above-mentioned manner, unwinding of the roving ends is prevented and problems caused by unwinding of the roving ends, such as yarn-breaking in the spinning frame, reduction of supplied roving from a roving bobbin, and scattering of fibers created by unwinding of roving ends, can be prevented.

Figure 5:
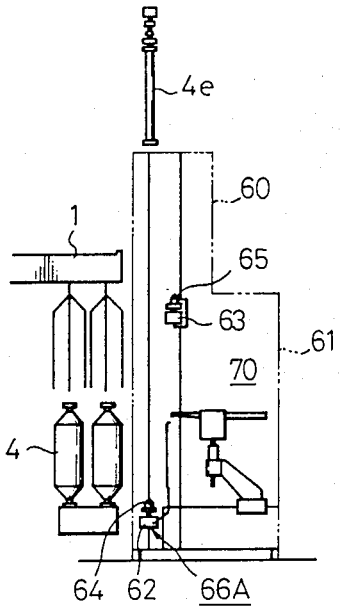
FIG. 5 is a schematic side view of an embodiment in which the roving end unwinding-preventing apparatus of the present invention is combined with a part of mechanical elements constituting a wagon type doffing apparatus, in which a system is adopted for transfering a full roving bobbin doffed by this doffing apparatus to corresponding bobbin hangers of a bobbin carriage of a transporting apparatus of the overhead roving bobbin transporting system shown in FIG. 1.
Figure 6:
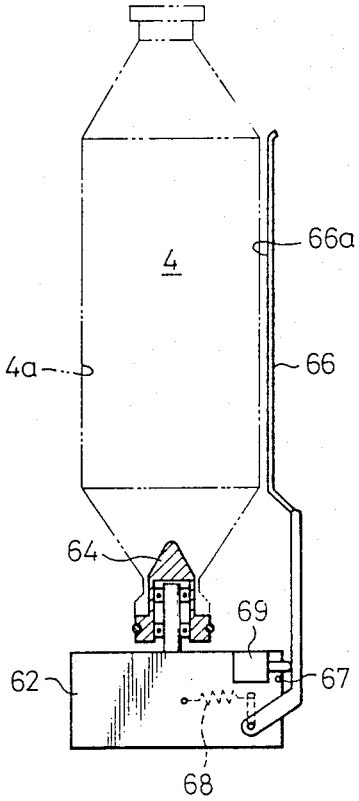
FIG. 6 is a partial side view of the apparatus of the present invention shown in FIG. 5.

FIGS. 5 and 6 illustrate an embodiment in which the present invention is applied to the wagon type doffing machine disclosed in the specification of Japanese Patent Unexamined Publication No. 61-174432. A doffer 60 is arranged movably along the front face of the roving frame 1, and two pairs of peg bars 62 and 63 are mounted on a frame 61 of the doffer 60 so that the peg bars 62 and 63 can be moved in the vertical direction by an appropriate lift mechanism. The doffer 60 is provided with a mechanism 60A for transferring roving bobbins 4 received from the respective bobbin wheels of the roving frame 1 to the respective bobbin hangers 16 of the bobbin carriage 11. This bobbin transfer mechanism 60A is provided with a pair of peg bars 62, 63 whereon four or six pegs 64, 65, are mounted respectively, and these peg bars 62, 63 are capable of displacing in the vertical direction respectively in relation to the condition thereof by a lifting mechanism mounted on a machine frame 61 of the doffer 60. A doffing mechanism 70 is mounted on the frame 61 of the doffer 60 for doffing roving bobbins 4 of the roving frame 1 and mounting them on the respective pegs 64 of the peg bar 62 in the falling condition or taking out empty bobbins 4*e* mounted on pegs 65 of the peg bar 63 in the falling condition and mounting them on the respective bobbin wheels of the roving frame. The peg bar 62 is utilized as a constitutional element of the present invention as a moving body having supporting members for holding roving bobbins, while the peg 64 functions as the above-mentioned supporting member. The pegs 64 of the peg bar 62 are rotatably arranged as in the embodiment shown in FIGS. 3 and 4 so that only while the peg bar 62 is in the rising condition are each of the pegs 64 revolved in the roving-winding direction of the roving bobbins 4 by a driving motor of a bobbin-rotating mechanism (not shown). Regarding each peg 64, a pressing member 66 is pivoted on the peg bar 62 at this base portion and the pressing member 66 is urged toward the axial line of the peg 64 by a spring 68 so that the pressing member 66 abuts against a stopper 67. Only while the peg bar 62 is in the falling condition and the rising condition, is the pressing member 66 released from the pressing action thereof by an action of a solenoid 69 as a releasing member, or a cam. Accordingly, if the roving bobbins 4 are mounted on the respective pegs 64 of the peg bar 62 in the falling condition and then the peg bar 62 is displaced upwards, the pressing surface 66*a* of the pressing member 66 comes into pressure contact with the peripheries of windings 4*a* of each roving bobbin 4 while the roving bobbin 4 is rotated in the roving-winding direction, whereby the roving ends can be firmly attached to the windings 4*a* of all roving bobbins 4.

In the above-mentioned embodiments of the roving end unwinding-preventing apparatus of the present invention, the apparatus exerts the intended function during the operation of transporting roving bobbins, where full roving bobbins doffed from the respective bobbin wheels of the roving frame are transported and transfered to the respective bobbin hangers of the bobbin carriage of the above-mentioned overhead type roving bobbin transporting system. An embodiment of the present invention applied to the overhead type roving bobbin transporting system, wherein the apparatus of the present invention functions in the time of carrying the roving bobbins forwards along the transporting rail by displacing the bobbin carriage forwards, will now be described. In this embodiment, the explanation of the mechanism and function of the overhead type roving bobbin transporting system per se is omitted, to avoid duplication.

Figure 8:
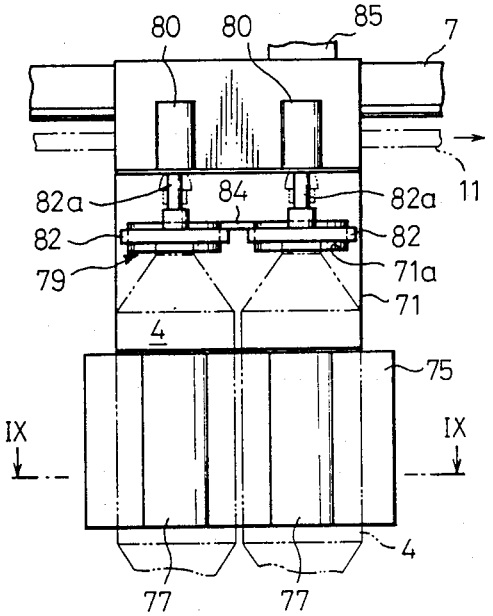
FIG. 8 is a partial front view of an embodiment in which the roving end unwinding-preventing apparatus shown in FIG. 7 is built in the transporting apparatus (the profile is shown by the dotted line) located at the position VIII (indicated by the arrow) of the transporting system shown in FIG. 2.
Figure 7:
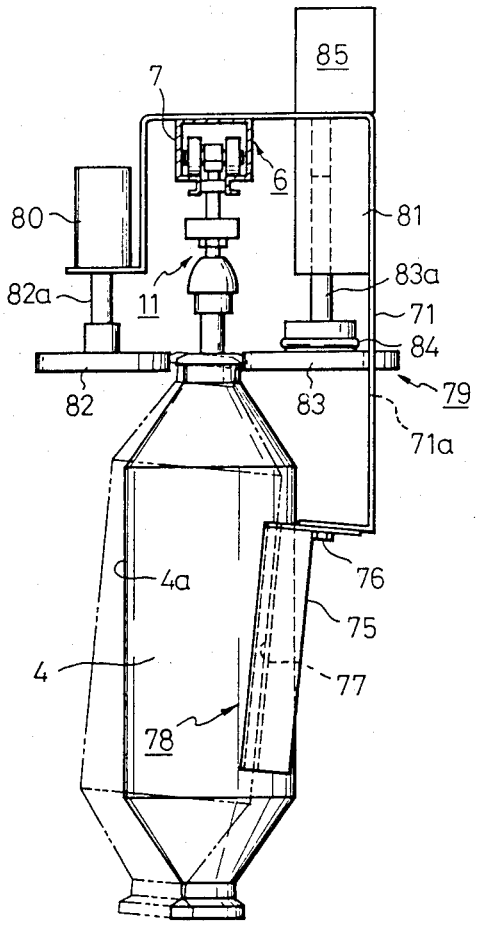
FIG. 7 is a partial side view of the roving end unwinding-preventing apparatus according to the present invention, which is built in the bobbin transporting rail along which bobbin carriages of the roving bobbin transporting system shown in FIG. 1 can be displaced.
Figure 9:
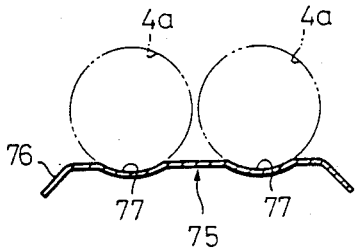
FIG. 9 is a sectional view showing the section taken along the line IX—IX in FIG. 8.

FIGS. 7 through 9 illustrate an embodiment where the roving end unwinding-preventing apparatus of the present invention is applied to the overhead type roving transporting apparatus shown in FIG. 2 wherein the profile of the apparatus of the present invention is shown by a one-dot chain line. In the drawings, a device for pressing the peripheral surface of the winding portion of roving bobbins is arranged in the midway of a passage for transporting roving bobbins 4 by the bobbin carriage 11. For facilitating the illustration, in FIG. 8, this device 75 is located at a second stop station in the transporting track from the position of the bobbin hanger 16 where the roving bobbins 4 are transferred by the bobbin-displacing device 20, however, preferably, the device 74 is located at a first stop position. In this device 74, a pressing plate 75 is secured to a bracket 71 fixed to the transporting rail 7 through an attachment screw 76, and the pressing plate 75 is located so that the lower end portion of the pressing plate 75 is exposed into the transporting passage for the roving bobbins 4 of the bobbin carriage 11, as shown in FIG. 9. On the lower end portion of the pressing plate 75, there is formed a positioning recess 77 in which the peripheral face 4*a* of the winding portion of each roving bobbin 4 is fitted by its own weight in the state where the bobbin carriage 11 is intermittently stopped, whereby a swinging movement of the intermittently stopped roving bobbins 4 is prevented, so that the peripheral face of the winding portion 4*a* of the roving bobbin 4 can be subjected to a firm pressure.

A bobbin-rotating mechanism 79 rotates each roving bobbin 4, regulating the suspended condition thereof by the member 75, in the roving-winding direction, and each roving bobbin 4 is rotated in the condition where the top end of the roving bobbin 4 is pressed from both sides. In this bobbin-rotating mechanism 79, two pairs of bearings 80 and 81 are secured to the bracket 71, as shown in FIG. 7. The bearings 80 and 81 rotatably support shafts 82*a* and 83*a* of rotating rollers 82 and 83 respectively. A belt 84 is laid on the two shafts 83*a* on one side and one of these shafts 83*a* is rotated in one direction by a driving motor 85 secured to the bracket 71. The distance between the rotating rollers 82 and 83 is set so that the top end of each roving bobbin 4 regulating the suspended condition thereof is pressed from both sides thereof. Note, one of the paired shafts 82*a* and 83*a*, preferably the driven shaft 82*a*, may be supported so that the driven shaft 82*a* can approach to and separate from the driving shaft 83*a*, and each roving bobbin 4 may be resiliently pressed by the rotating rollers 82 and 83 when the shaft 8*a* is urged toward the shaft 83*a* by a spring. One rotating roller 83 is intruded into a window 71*a* of the bracket 71.

Referring to FIGS. 2 and 3, as mentioned above, as a first step, the roving bobbins 4 are simultaneously doffed on pegs 5*a* of the peg conveyor 5 from the roving frame 1 by the doffing machine 3, then the roving bobbins 4 on the peg conveyor 5 are transferred to the bobbin-displacing device 20 and mounted on the respective pegs 32 on the lifter 27, and the lifter 27 is displaced upward and the top ends of the roving bobbins 4 are caught by the respective bobbin hangers 16 of the bobbin carriage 11. When the lifter 27 then is displaced downwards, this downward displacement is detected by an appropriate detecting means and the brake motor 54 of the intermittent feed device 49 of the foregoing embodiment (FIG. 2), which is utilized as a constitutional element of the present invention, is driven to advance one cross rider 58 and cause the cross rider 58 to act on the indexing pin 17 of the bobbin carriage 11, whereby the bobbin carriage 11 is moved in the delivery direction by a distance which is twice that of the pitch P of the bobbin hangers 16.

If the bobbin carriage 11 is moved by a distance twice that of the pitch P, the roving bobbins 4 mounted on the respective bobbin hangers 16 are displaced in the suspended condition. During this movement, the intermediate parts of the roving bobbins 4 are guided by the guide portion 76 of the pressing member 75 and each winding portion 4*a* of the roving bobbin 4 is fitted in one of the positioning recesses 77 by the weight of the roving bobbins 4 themselves, and as a result, the peripheral faces of the winding portion 4*a* of each roving bobbin 4 is pressed against the inner face of the respective positioning recesses 77 of the pressing member 75 by the weight of the roving bobbins 4 themselves. When the roving bobbins 4 are displaced in the above-mentioned manner, the top ends of the roving bobbins 4 are fed between the corresponding pair of the rotating rollers 82 and 83. After the bobbin carriage 11 is displaced and stopped, the rotating rollers 82 and 83 are rotated for a predetermined time by the driving motor 85, and as a result, the rotating rollers 82 and 83 rotate the roving bobbins 4 in the winding direction thereof.

The above-mentioned intermittent movement of the bobbin carriage 11 is effected every time the roving bobbins 4 are mounted on the respective bobbin hangers 16. When the above-mentioned intermittent movement of the bobbin carriage 11 is repeated and the final roving bobbins 4 doffed from the roving frame 1 are located at the positioning recess 77 to complete the pressing of the roving ends against the windings, the bobbin carriage 11 is moved to the respective positions above the spinning frame 2 by a continuous feeding device, which will be explained hereinafter. In this case, although the roving ends will be unwound because the roving bobbins 4 suspended from the respective bobbin hangers 16 are swung according to the movement of the bobbin carriage 11 or because air currents act on the roving bobbins 4 in the mill, since the roving ends of the roving bobbins 4 are pressed against the peripheral faces of the winding portion 4*a* of the roving bobbins 4 as mentioned above, unwinding of the roving ends can be effectively prevented, whereby the problems described in the previous embodiment can be prevented.

Figure 11:
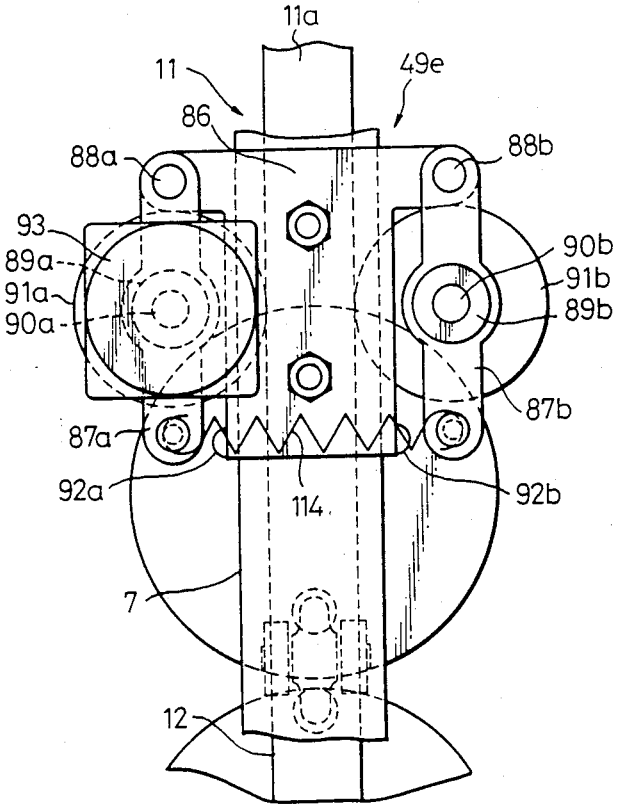
FIG. 11 is a plane view of the transporting apparatus shown in FIG. 10.
Figure 10:
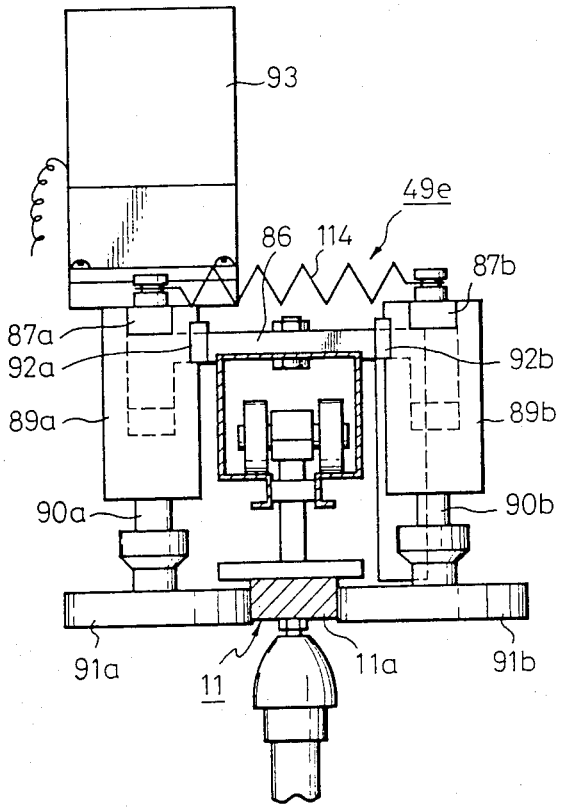
FIG. 10 is a partial sectional side view (seen from the carrying direction along the transporting rail) showing another embodiment of the transporting apparatus used in the roving bobbin transporting system shown in FIG. 1, in which the roving end unwinding-preventing apparatus of the present invention is built.
Figure 12:
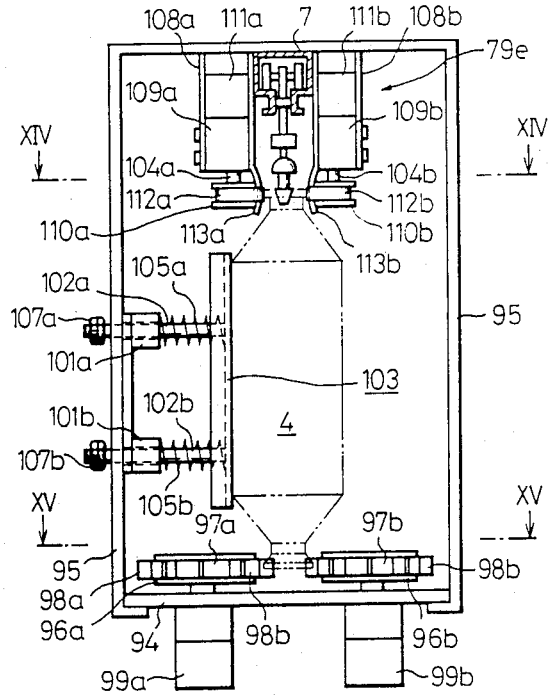
FIG. 12 is a partial sectional side view (seen from the carrying direction of the transporting system) illustrating another embodiment of the roving end unwinding-preventing apparatus of the present invention which is built in the roving bobbin transporting system shown in FIG. 1.
Figure 13:
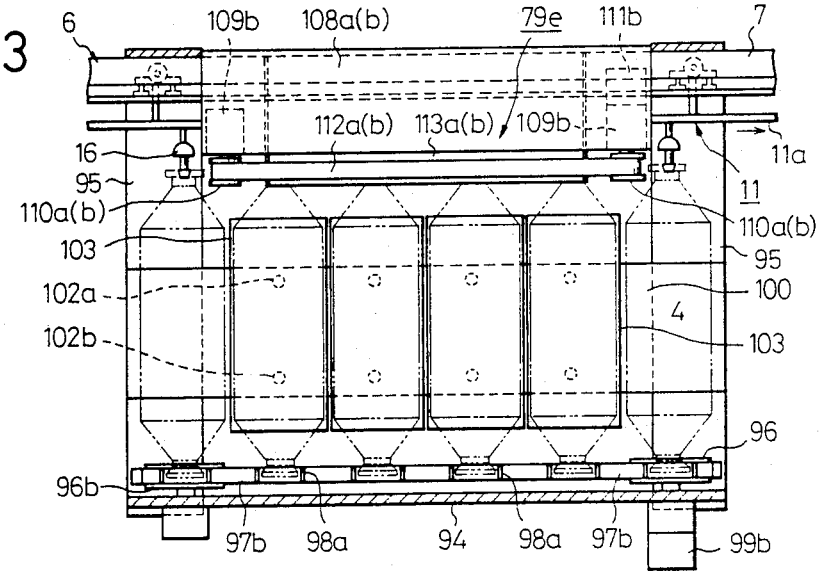
FIG. 13 is a partial front view of the apparatus shown in FIG. 12.
Figure 14:
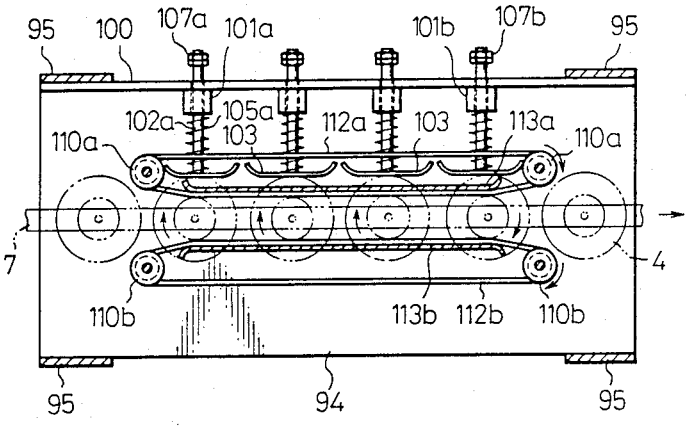
FIG. 14 is a view showing the section taken along the line XIV—XIV in the apparatus shown in FIG. 12; and, FIG. 15 is a view showing the section taken along the line XV—XV in the apparatus shown in FIG. 12.
Figure 15:
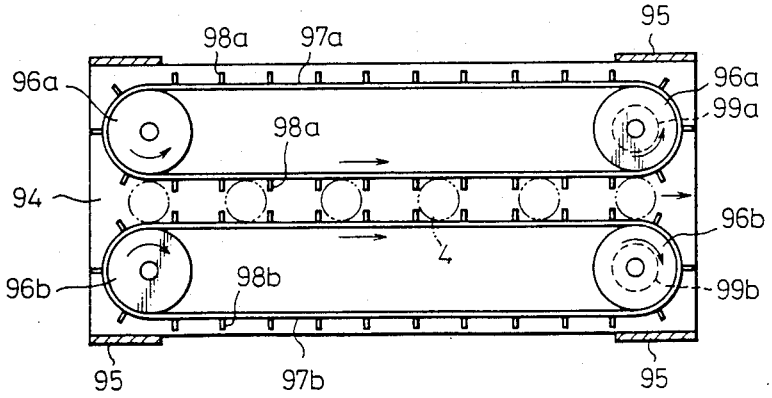

FIGS. 10 through 14 illustrate an embodiment in which the apparatus of the present invention is built midway in the passage for transporting roving bobbins to the respective positions above the spinning frames. Namely, in this embodiment, the operation of preventing unwinding of roving ends of roving bobbins is performed while the bobbin carriage 11 is continuously displaced. As shown in FIGS. 10 and 11 showing a continuous feeding device 49*e* in the midway of the transporting rail 7, the continuous feeding devices 49 are arranged at an intervened distance shorter than the total length of the bobbin carriage 11. In this continuous feeding device 49*e*, a supporting bracket 86 is secured to the transporting rail 7, a pair of supporting arms 87*a* and 87*b* are swingably pivoted on the supporting bracket 86 through vertical shafts 88*a* and 88*b*, and bearings 89*a* and 89*b* are secured to the intermediate parts of the supporting arms 87*a* and 87*b*. Roller shafts 90*a* and 90*b* are rotatably supported by the bearings 89*a* and 89*b*, and feed rollers 91*a* and 91*b* are secured to the lower end portions of the roller shafts 90*a* and 90*b*. The supporting arms 87*a* and 87*b* are urged inward by a spring 114 extended between the top end portions of the supporting arms 87*a* and 87*b* so that, if the bobbin carriage 11 is not present, the supporting arms 87*a* and 87*b* abut against stoppers 92*a* and 92*b* mounted on the supporting bracket 86. The feed rollers 91*a* and 91*b* are arranged so that when the bobbin carriage 11 is moved to the position of the feed rollers 91*a* and 91*b*, a carriage bar 11*a* of the bobbin carriage 11 is resiliently urged from both sides. A driving motor 93 is secured to one supporting arm 87*a* to rotate the rotor shaft 90*a* in one direction.

A supporting body 94 is secured to the transporting rail 7 through an attachment arm 95 and is located below the passage for transporting roving bobbins 4. A pair of pulleys 96*a* and 96*b* are rotatably disposed to the supporting body 94 and are located on both sides of the lower end of the transporting passage. Two pairs of pulleys 96*a* and 96*b* are arranged with a certain distance therebetween in the transporting direction, and rotary belts 97*a* and 97*b* in contact with the lower end portion of each roving bobbin 4 are laid between pairs of pulleys 96*a* and 96*b* respectively. On the peripheral side of the rotary belts 97*a* and 97*b*, positioning pieces 98*a* and 97*b* are arranged at predetermined pitches so that the positioning pieces 98*a* and 98*b* intrude between every two adjacent roving bobbins 4 carried in the suspended condition by the respective bobbin hangers 16 of the bobbin carriage 11, so that the suspended condition of the roving bobbins 4 can be maintained. The setting positions of the positioning pieces 98*a* and 98*b* are determined so that the positioning pieces 98*a* and 98*b* intrude before and after the lower end of each roving bobbin 4, respectively, and each roving bobbin 4 is transported in the condition in which it is positioned substantially vertically by the positioning pieces 98*a* and 98*b*. Driving motors 99*a* and 99*b* are disposed to rotate the rotary belts 97*a* and 97*b* in contact with the lower end portion of each roving bobbin 4 in the direction of the arrow at the same speed as the delivery speed of the bobbin carriage 11, and the driving motors 99*a* and 99*b* are secured to the supporting body 94 to rotate shafts of the pulleys 96*a* and 96*b*. A supporting plate 100 is secured to the attachment arm 95. A plurality of pairs, for example, 4 pairs in this embodiment, of upper and lower bearings 101*a* and 101*b* are arranged on the supporting plate 100 at intervals substantially equal to the pitches of the bobbin hangers 16. Supporting levers 102*a* and 102*b* are slidably inserted into the bearings 101*a* and 101*b*, and pressing plates 103 as the pressing member are secured to the respective top ends of the supporting levers 102*a* and 102*b*. The pressing member 103 is urged toward the carrying passage by springs 105*a* and 105*b* interposed between the pressing plate 103 and the supporting plate 100, and the pressing plate 103 is positioned so that, when stoppers 107*a* and 107*b* secured to the supporting levers 102*a* and 102*b* abut against the supporting plate 100, the pressing plate 103 is slightly exposed to the passage for transporting the roving bobbins 4. A pair of supporting frames 108*a*, 108*b* are secured to the transporting rail 7 and two pairs of bearings 109*a* and 109*b* are secured to the respective supporting frames 108*a*, 108*b* to rotatably support shafts of pulleys 110*a* and 110*b*. Driving motors 111*a* and 111*b* are secured to the respective supporting frames 108*a*, 108*b* to rotate the pulleys 110*a*, 110*b* in the direction of the arrow. Rotary belts 112*a* and 112*b* are laid between the respective pair of pulleys 110*a* and 110*b* and are rotated in the direction of the arrow. Belt guide plates 113*a* and 113*b* are secured to the transporting rail 7. The rotary belts 112*a* and 112*b* are arranged to press the top ends of the roving bobbins 4 from both sides in the suspended condition regulated by the device 74*e* and rotate the roving bobbins 4 in the roving-winding direction.

In the embodiment having the above-mentioned structure, when all the roving bobbins 4 doffed from the roving frame are mounted on the respective bobbin hangers 16 of the bobbin carriage 11, the driving motor 93 of the continuous feeding device 49*e* (FIG. 10) is actuated to rotate the feed rollers 91*a* and 91*b* in the direction of the arrow, whereby the carriage bar 12 of the bobbin carriage 11 is continuously displaced in the transporting direction. Before the carriage bar 12 separates from a position between the feed rollers 90*a* and 90*b* of the continuous feeding device 49*e*, the carriage bar 12 is resiliently urged from both sides by the feed rollers 90*a* and 90*b* of the subsequent feed device 49*e*, and the carriage bar 12 is thus displaced forwards successively. If the bobbin carriage 11 is continuously displaced in this manner, the lower end of each roving bobbin 4 suspended by the respective bobbin hangers 16 intrudes into a position between the rotary belts 97*a* and 97*b*, which are preliminarily rotating and the position of the roving bobbin 4 is regulated by the positioning pieces 98*a* and 98*b* of the rotary belts 97*a* and 97*b*, whereby possible swinging of the roving bobbins 4 can be prevented. Furthermore, the peripheral face of the winding portion 4a of each roving bobbin 4 abuts against the pressing plate 103 to deviate the pressing plate 103 sideways against the springs 105a and 105b and cause the pressing plate 103 to apply pressure to the peripheral face of the winding portion 4a of each roving bobbin 4. After the suspending condition of the lower end of the roving bobbin 4 is maintained, the upper end of the roving bobbin 4 intrudes into a position between the rotary belts 112a and 112b, which are preliminarily rotating, of the bobbin-rotating mechanism 79e and is resiliently urged from both sides by the rotary belts 112a and 112b and rotated in the winding direction of the roving bobbins 4. In this case, since the suspended condition of each roving bobbin 4 is maintained by the belts 97a, 97b and the peripheral face of each winding portion 4a of the roving bobbin 4 is pressed by the pressing plate 103, when the roving bobbin 4 is rotated in the winding direction, the roving end is firmly attached on the peripheral face of the winding portion 4a of each roving bobbin 4.

From the practical point of view of application of the present invention, the preferable embodiments can be classified into two categories; i.e., the embodiments shown in the drawings from FIG. 1 to FIG. 6 and the embodiments shown in the drawings from FIG. 7 to FIG. 15.

In the embodiments illustrated in FIGS. 1 through 6, where full roving bobbins doffed from the respective bobbin wheels of the roving frame are displaced upward for mounting the full roving bobbins on the respective bobbin hangers of the bobbin carriage provided in the overhead type roving bobbin transporting system, since the holding condition of each roving bobbins is maintained by pegs on the transporting member and the roving bobbins are rotated in the winding direction of the roving bobbin by the bobbin-rotating mechanism in the state where pressure is applied to the peripheral face of winding of each roving bobbin by the pressing member, the roving end of each roving bobbin doffed from the roving frame can be firmly pressed against the winding, and unwinding of the roving ends can be prevented during the transportation of the roving bobbins or during the subsequent steps, whereby the possible problem of unwinding of the roving ends, as pointed out in the previous paragraph, can be effectively prevented.

In the embodiments illustrated in FIGS. 7 through 15, where roving bobbins are transported in the suspended condition by the respective bobbin hangers, the suspended condition of the roving bobbins is maintained and the peripheral face of the winding portion of each roving bobbin is pressed by the pressing member, and in this state, the roving bobbins are rotated in the winding direction of the roving bobbin by the bobbin-rotating mechanism. Accordingly, the roving end of each roving bobbin carried in the suspended condition can be firmly attached to the winding portion of the respective roving bobbins. In each of the above mentioned embodiments, unwinding of the roving ends can be prevented during the transportation of the roving bobbins or during the subsequent steps, and therefore, the possible problem of the unwinding of the roving ends mentioned above can be prevented. Moreover, since unwinding of the roving ends is performed automatically while the roving bobbins are carried by the bobbin carriage, the time for transporting the roving bobbins can be effectively utilized.

We claim:

1. Apparatus for preventing unwinding of roving ends comprising in combination with an apparatus for transporting full packaged roving bobbins doffed from respective bobbin wheels of a roving frame to predetermined positions, said transporting apparatus being provided with a device for displacing said roving bobbins, said device being provided with a plurality of members for supporting said roving bobbins in substantially vertical condition respectively and a body whereon said supporting members are rotatably mounted, and means for displacing said body along a predetermined track, whereby said roving bobbins are supported by said supporting members during displacement of said body, a member for pressing a periphery surface of a winding portion of each of said roving bobbins and a mechanism for rotating said roving bobbins in a winding direction of said roving bobbins under contacting pressure by said pressing member, said pressing member being disposed at a position adjacent to said predetermined track for transporting said roving bobbins.

2. Apparatus for preventing unwinding of roving ends according to claim 1, wherein said apparatus is applied for a system of doffing full packaged roving bobbins from respective bobbin wheels of a roving frame by means of a doffing device and of transferring said doffed roving bobbins to respective bobbin hangers of a bobbin carriage of an overhead transporting system by means of a displacing device, whereby said roving bobbins are transported for positions above said roving frame to respective positions above a spinning frame along a transporting rail system arranged between said positions above said roving frame and said positions above said spinning frame, said apparatus for preventing unwinding of the roving ends is constructed in combination with elements of said displacing device, wherein each of said supporting members comprises a peg for supporting a full packaged roving bobbin doffed from said roving frame by means of said doffing device, said body comprises a member for holding said pegs, said displacing means comprises a lifting mechanism for displacing said holding member between a position of receiving doffed roving bobins from said doffing device and a position for transferring said roving bobbins to said respective bobbin hangers, and said rotating mechanism comprises a device for rotating said pegs, said pressing member and said rotating device being mounted on said displacing device.

3. Apparatus for preventing unwinding of roving ends according to claim 2, wherein said pressing member is a spring plate extended along almost the whole length of said roving bobbin in an axial direction of said roving bobbin, further comprising a member for releasing the pressing action of said pressing member when said lifting device is at its lowermost position.

4. Apparatus for preventing unwinding of roving ends according to claim 2, wherein said apparatus is constructed in combination with elements of said displacing device disposed at a position adjacent to an end of a simultaneous doffing device, which is arranged in front of said roving frame and provided with a peg conveyer having a plurality of pegs for receiving all full packaged roving bobbins doffed from said bobbin wheels of said roving frame, said displacing device transferring roving bobbins received form said pegs of said peg conveyer to the respective bobbin hangers of bobbin carriages which are elements of said overhead transportation system.

5. Apparatus for preventing unwinding of roving ends according to claim 2, wherein said apparatus is constructed in combination with elements of said displacing device formed in a known wagon type doffing apparatus which is capable of displacing along said roving frame in a facing condition to said roving frame so that said doffing operation is carried out, said displacing device transferring roving bobbins received from the respective bobbin wheels of said roving frame to the respective bobbin hangers of bobbin carriages which are elements of said overhead transportation system.

6. Apparatus for preventing unwinding of roving ends according to claim 1, wherein said apparatus is constructed in combination with elements of an overhead transportation system for transporting roving bobbins from respective positions above said roving frames to respective positions above said spinning frames along a track arranged between said positions, wherein each of said supporting members comprises a bobbin hanger, said body comprises a bobbin carriage on which said bobbin hangers are rotatbly mounted, and said displacing means comprises a driving mechanism for displacing said bobbin carriage along said track, and said pressing member is disposed at a position proximal to the transporting passage for said roving bobbins formed by said track, said pressing member and said mechanism for rotating said roving bobbins being disposed on said track.

7. Apparatus for preventing unwinding of roving ends according to claim 6, wherein said pressing member is provided with recesses for receiving a peripheral portion of said roving bobbins, said pressing member being disposed on said track at a position where said displacing mechanism is stopped while said rotation mechanism is actuated to rotate said roving bobbins under application of contact pressure by said pressing member.

8. Apparatus for preventing unwinding of roving ends according to claim 6, wherein said rotation mechanism comprises a pair of first revolving endless belts which rotate said roving bobbins in the winding direction thereof in such condition that an upper end portion of each of said roving bobbins is urged by said endless belts from both sides while said roving bobbins are being transported, and a pair of second revolving endless belts which rotate said roving bobbins in the same condition as said first revolving endless belts simultaneously in such condition that a lower end portion of each of said roving bobbins is urged by said second endless belts from both sides, said pressing member being provided with a plate like presser having resilient force for pressing the peripheral surface of the winding portion of each roving bobbin.

* * * * *